United States Patent [19]

Deis et al.

[11] 4,433,608

[45] Feb. 28, 1984

[54] ELECTROMAGNETIC PROJECTILE LAUNCHER WITH AN AUGMENTED BREECH

[75] Inventors: Daniel W. Deis, Churchill Borough; Ian R. McNab, Murrysville, both of Pa.; Joseph L. Smith, Jr., Concord, Mass.

[73] Assignee: Westinghouse Electric Corp., Pittsburgh, Pa.

[21] Appl. No.: 327,154

[22] Filed: Dec. 3, 1981

[51] Int. Cl.[3] ..... F41F 1/02; H02K 41/02

[52] U.S. Cl. ..... 89/8; 124/3; 310/13

[58] Field of Search ..... 89/8; 124/3; 310/13, 310/10

[56] References Cited

U.S. PATENT DOCUMENTS

| | | | |
|---|---|---|---|
| 1,370,200 | 3/1921 | Fauchon-Villeplee | 89/8 |
| 2,870,675 | 1/1959 | Salisbury | 89/8 |
| 4,319,168 | 3/1982 | Kemeny | 124/3 |
| 4,343,223 | 8/1982 | Hawke et al. | 89/8 |
| 4,347,463 | 8/1982 | Kemeny et al. | 124/3 |
| 4,369,691 | 1/1983 | Baehr, Jr. et al. | 124/3 |
| 4,369,692 | 1/1983 | Kemeny | 124/3 |

FOREIGN PATENT DOCUMENTS

| | | | |
|---|---|---|---|
| 496325 | 11/1919 | France | 124/3 |
| 144411 | 6/1920 | United Kingdom | 124/3 |

OTHER PUBLICATIONS

LA-8000-C, "Electromagnetic Accelerator Concepts", Kolm, pp. 206-209, (7/79).

*Primary Examiner*—Sal Cangialosi
*Attorney, Agent, or Firm*—R. P. Lenart

[57] ABSTRACT

An electromagnetic projectile launching system is provided with a rail configuration in the breech area which increases the electromagnetic field to increase armature acceleration and initiate sliding current transfer at a lower current. Two configurations are disclosed. The first comprises multiple rails disposed parallel to the launcher barrel rails in tne breech region and connected in series such that current in the multiple rails flows in the same direction as current in the closest barrel rail. Connecting shunts are disposed in equal numbers on opposite sides of the barrel rails to balance electromagnetic forces. The second configuration comprises non-parallel barrel rails containing a bend in the breech region.

17 Claims, 4 Drawing Figures

ELECTROMAGNETIC PROJECTILE LAUNCHER WITH AN AUGMENTED BREECH

BACKGROUND AND SUMMARY OF THE INVENTION

This invention relates to electromagnetic projectile launchers and more particularly to such launchers with a rail geometry which provides an augmented electromagnetic field in the breech area.

Electromagnetic projectile launchers are known which comprise a pair of conductive rails, a sliding conductive armature between the rails, and means for commutating a large direct current into the rails and through the armature. Current flow places an electromagnetic force on the armature which propels it along the conductive rails. An early launcher employing this concept is disclosed in U.S. Pat. No. 1,370,200, dated Mar. 1, 1921.

Prior to acceleration, conductive armatures are either stationary in the rail breech area or are inserted into the breech area at a relatively slow velocity. In order to develop an electromagnetic launcher capable of rapid firing, a technique for initiating projectile motion without damaging the projectile armature or the breech rail section is essential. The early stages of acceleration are most critical in this regard since high current density current transfer is most difficult to achieve without damage at zero or very low velocities. Copending application Ser. No. 137,059, filed Apr. 3, 1980 by Kemeny and Litz, now U.S. Pat. No. 4,347,463 entitled "Electromagnetic Projectile Launcher With Self-Augmented Rails", and assigned to the present assignee, discloses a launcher which employs additional conductors parallel to the rails to increase force on an armature for a given rail current. These additional conductors can run the full length of the rails and add significant resistance and inductance to the rail system. The present invention seeks to increase armature acceleration in the breech area for a given rail current to minimize rail and armature damage. This is accomplished with relatively short breech augmenting rail configurations, thereby minimizing resistive and inductive effects of the augmentation. Limiting augmentation to the breech area also minimizes launcher weight at the muzzle end thereby maintaining launcher maneuverability. Both parallel and nonparallel rail geometries are used to achieve breech augmentation. Since augmentation occurs during current commutation into the breech, peak acceleration of the armature and projectile need not be increased.

This invention comprises: a pair of conductors in the form of rails; a movable conductive armature between these rails; a source of high current; a switch for commutating this current to the rails and armature; and means for increasing the magnetic field in the breech area comprising, a breech augmenting conductor rail assembly which increases the electromagnetic force on a projectile in the breech area for a given current. One embodiment of this breech augmenting rail assembly comprises additional rails which are parallel to the first pair of rails and located near the breech section. These additional rails are located adjacent the pair of conductive rails and carry current in a direction which augments the electromagnetic field in the breech area.

A second embodiment of the breech augmenting rail assembly provides for augmentation of the electromagnetic field in the breech area through the use of a nonparallel rail geometry where the pair of conductive rails are bent at an angle near the breech area. This produces a repulsive magnetic field between a section of rail and the movable armature which serves to increase initial armature acceleration.

DESCRIPTION OF THE PREFERRED EMBODIMENTS

Figure 1:
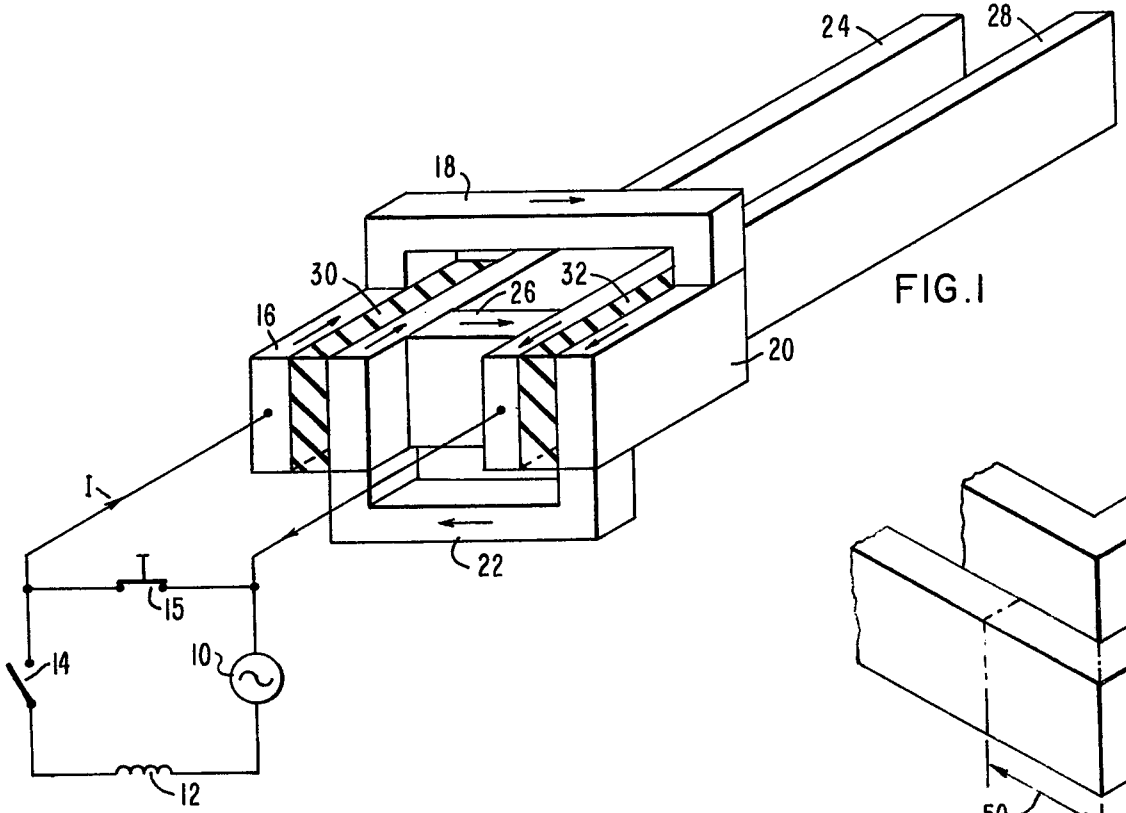
FIG. 1 shows an embodiment of an electromagnetic launcher with breech augmenting rails in accordance with the present invention.

FIG. 1 shows an embodiment of an electromagnetic projectile launching system in accordance with the present invention. The series circuit comprising generator 10, induction coil 12, and switch 14 is connected between augmenting rail 16 and barrel rail 28. Circuit breaker 15 is connected in parallel with this series circuit and provides a means for rapidly commutating current into augmenting rail 16 and barrel rail 28. Augmenting rails 16 and 20 are disposed generally parallel to the breech ends of barrel rails 24 and 28 respectively. Insulator 30 separates augmenting rail 16 and barrel rail 24. Insulator 32 separates augmenting rail 20 and barrel rail 28. Shunt 18 connects the ends of augmenting rails 16 and 20 which are opposite the breech ends. Shunt 22 is disposed on the side of barrel rails 24 and 28, opposite that of shunt 18 and connects the breech ends of augmenting rail 20 and barrel rail 24.

When switch 14 is closed, generator 10 charges induction coil 12 to maximum current. At that time, circuit breaker 15 is opened, commutating current to the launcher rails. The arrows in FIG. 1 illustrate that the current I flows through augmenting rail 16, shunt 18, augmenting rail 20, and shunt 22 into barrel rail 24. Then it flows through movable armature 26 and barrel rail 28, back to generator 10. This creates electromagnetic forces which propel armature 26 along barrel rails 24 and 28.

Since current flow in each augmenting rail 16 and 20 and the closest barrel rail 24 and 28, respectively, is in the same direction, the resulting electromagnetic forces in the breech area are greater than those found in a launcher which does not utilize breech augmenting rails. Therefore, armature 26 is subjected to larger forces and its acceleration is increased. This minimizes damage to the breech area of the barrel rails 24 and 28 by shortening the time required to achieve a desired armature speed. Alternatively, a smaller current could be used to attain the acceleration found in launchers which do not utilize augmenting rails.

Shunts 18 and 22 are arranged on opposite sides of barrel rails 24 and 28 in order to balance electrical forces in the breech area. The augmenting rail lengths can be varied to achieve a desired level of acceleration.

It should be apparent to those skilled in the art that the breech augmentation system shown in FIG. 1 can also be used on launchers which employ multiple barrel rails.

Figure 2:
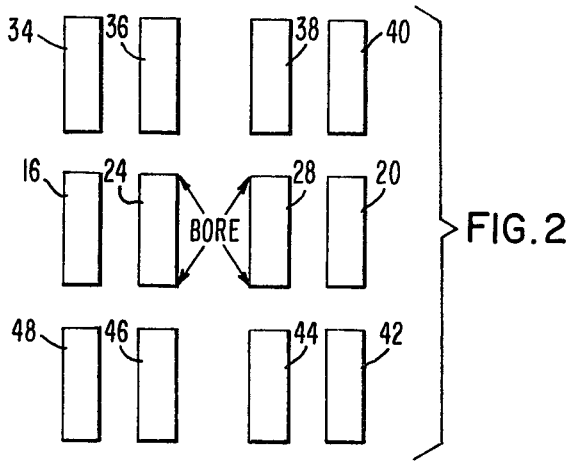
FIG. 2 shows a cross-sectional view of the breech area of an electromagnetic launcher with a plurality of breech augmenting rails in accordance with an embodiment of the present invention.

Additional breech augmenting rails could be added to the launching system of FIG. 1 without departing from the scope of this invention. FIG. 2 shows a cross section of the breech area of a launcher with ten augmenting rails. The current through augmenting rails 20, 38, 40, 42 and 44 would travel in the same direction at the current in barrel rail 28. Similarly, the current through augmenting rails 16, 34, 36, 46 and 48 would travel in the same direction as the current in barrel rail 24. Shunt conductors between the rails would be arranged such that an equal number pass above and below the barrel rails.

Augmenting rail lengths would typically range from ten to twenty centimeters. Since this is small in comparison to typical barrel rail lengths, the series resistance of the augmenting rails will not adversely affect system performance.

Figure 3:
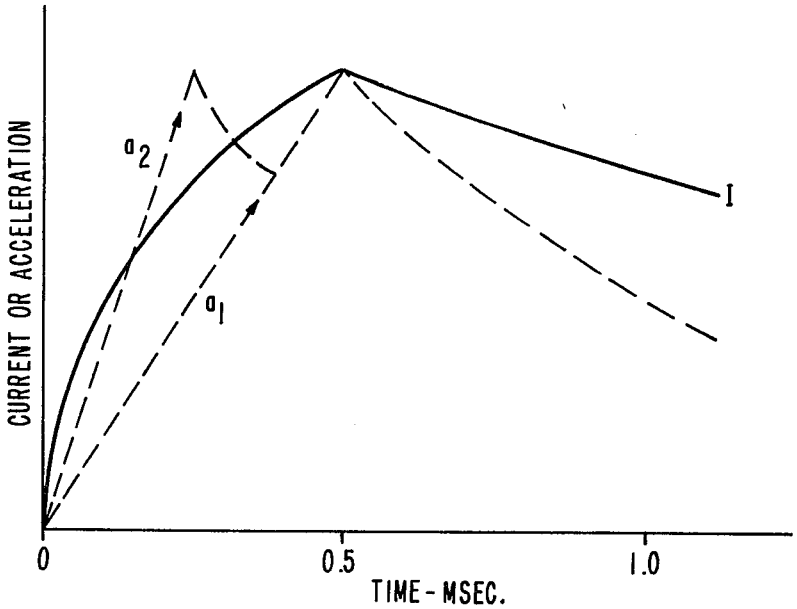
FIG. 3 shows a typical current-time relationship for an electromagnetic launcher and illustrates the effect of breech augmentation on armature acceleration.

FIG. 3 shows a typical current-time relationship for an electromagnetic launcher starting at the point where current commutation into the breech begins. The commutation time, shown here as 0.5 msec, can vary from 0.25 to 1.0 msec based on present switch designs. Acceleration time can vary from 1.5 to 3.0 msec for high velocity systems and up to 1.0 sec for low speed systems. The acceleration, a, is proportional to the current squared, $I^2$. In FIG. 3, I represents current and $a_1$ represents the acceleration as a function of time for a barrel configuration consisting of a pair of barrel rails without augmenting rails. By adding one set of augmenting rails as illustrated in FIG. 1, the acceleration can be increased to that shown by $a_2$ in FIG. 3. The length of the augmenting rails is adjusted such that the maximum acceleration is not exceeded, thereby avoiding stress problems in the launch package.

The use of breech augmentation rails thus increases armature velocity at a faster rate and also initiates sliding current transfer at a lower current, both of which will reduce the likelihood of armature or rail damage. Depending upon the increased force desired in the breech area, any combination of augmentation rails can be added as illustrated by FIG. 2.

Figure 4:
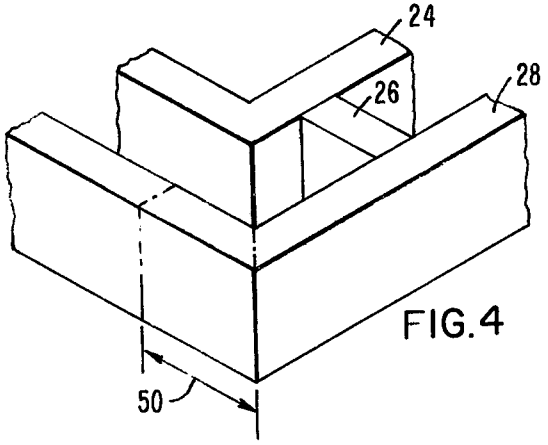
FIG. 4 shows the breech area of an electromagnetic launcher utilizing a nonparallel augmentation system in accordance with an embodiment of the present invention.

An alternative embodiment of the breech of an augmented breech launcher is shown in FIG. 4. A nonparallel rail geometry is shown in which additional force is obtained from rail section 50 since its magnetic field will increase the total magnetic field behind armature 26. This force will decrease rapidly as the armature moves out of the breech area. Barrel rails 24 and 28 are bent to form a right angle at the launcher breech, and positioned equidistant from each other. This provides for a generally parallel arrangement of armature 26 and rail section 50.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims.

What is claimed is:

1. An electromagnetic projectile launching system comprising:

a first conductor;

a second conductor disposed generally parallel to said first conductor;

means for propelling a projectile from a breech end of said first and second conductors to a muzzle end thereof and for conducting current therebetween;

a third conductor disposed generally parallel and adjacent to the breech end of said second conductor and being electrically connected to said first conductor adjacent said breech end thereof;

a fourth conductor disposed generally parallel and adjacent to the breech end of said first conductor and being electrically connected to said third conductor at an end opposite said third conductor's connection to said first conductor;

a source of current electrically connected to the breech end of said fourth conductor and to the breech end of said second conductor;

circuit breaking means electrically connected in parallel with said current source, whereby the current required for launching the projectile is rapidly commutated to said fourth and second conductors and is at a lower value than required utilizing a single pair of conductors to achieve the same amount of force on a projectile; and each of said third and fourth conductors having a length which is less than the distance traveled by said means for propelling while current in said first and second conductors is increasing.

2. An electromagnetic projectile launching system as recited in claim 1, wherein said means for propelling a projectile is a conductive armature slidably disposed between said first and second conductor.

3. An electromagnetic projectile launching system as recited in claim 1, wherein said circuit breaking means is a switch.

4. An electromagnetic projectile launching system as recited in claim 1, further comprising electrical insulation disposed between said first and fourth conductors and between said second and third conductors.

5. An electromagnetic projectile launching system as recited in claim 1, wherein said source of current comprises:

an inductive coil; and a direct current generator connected in series with said induction coil.

6. An electromagnetic projectile launching system as recited in claim 1, wherein the current in said first and fourth conductors flows in the same direction and the current in said second and third conductors flows in the same direction.

7. An electromagnetic projectile launching system as recited in claim 1, further comprising:

a first shunt between said first and third conductors; and a second shunt between said third and fourth conductors.

8. An electromagnetic projectile launching system as recited in claim 7, wherein said first and second shunts are disposed on opposite sides of said first and second conductors.

9. An electromagnetic projectile launching system comprising:

a first conductor;

a second conductor disposed generally parallel to said first conductor;

said first and second conductors having a breech end and a muzzle end;

means for propelling a projectile from said breech end of said first and second conductors to said muzzle end and for conducting current therebetween;

a source of current;

means for switching current from said current source to said first and second conductors to produce a magnetic field between said first and second conductors; and means for increasing said magnetic field at said breech end of said first and second conductors with respect to said magnetic field elsewhere between said first and second conductors, wherein the portion of said first and second conductors over which said magnetic field is increased has a length which is less than the distance traveled by said means for propelling while current in said first and second conductors is increasing.

10. An electromagnetic projectile launching system as recited in claim 9, wherein said means for increasing said magnetic field comprises:

additional conductors disposed in groups generally parallel to said first and second conductors and adjacent the breech end of said first and second conductors;

said additional conductors being electrically connected so that conductors disposed adjacent said first conductor have current that flows in the same direction as in said first conductor and conductors disposed adjacent said second conductor have current that flows in the same direction as in said second conductor.

11. An electromagnetic projectile launching system as recited in claim 9, wherein said means for propelling a projectile is a conductive armature slidably disposed between said first and second conductors.

12. An electromagnetic projectile launching system as recited in claim 9, further comprising electrical insulation disposed between said additional conductors and said first and second conductors.

13. An electromagnetic projectile launching system as recited in claim 9, wherein said source of current comprises:

an induction coil; and a direct current generator connected in series with said induction coil.

14. An electromagnetic projectile launching system comprising:

a first conductor containing a right angle bend;

a second conductor disposed generally equidistant from said first conductor;

means for propelling a projectile from said right angle bend to one end of said first and second conductors and for conducting current therebetween, said means for propelling being initially disposed to conduct current in a direction which is opposite and generally parallel to a portion of said first conductor adjacent to said right angle bend;

a source of current electrically connected to said first and second conductors; and circuit breaking means electrically connected in parallel with said source of current, whereby the current required for launching the projectile is rapidly commutated to said first and second conductors and is at a lower value than required utilizing a pair of conductors which do not contain a right angle bend to achieve the same amount of force on a projectile.

15. An electromagnetic projectile launching system as recited in claim 14, wherein said means for propelling a projectile is a conductive armature slidably disposed between said first and second conductors.

16. An electromagnetic projectile launching system as recited in claim 14, wherein said circuit breaking means is a switch.

17. An electromagnetic projectile launching system as recited in claim 14, wherein said source of current comprises:

an induction coil; and a direct current generator connected in series with said induction coil.

* * * * *